US007246914B2

(12) United States Patent
Amorin

(10) Patent No.: US 7,246,914 B2
(45) Date of Patent: Jul. 24, 2007

(54) PORTABLE ILLUMINATION DEVICE

(75) Inventor: Teresa Amorin, King's Ct. #S1, Apt. 2-A, San Juan, PR (US) 00909

(73) Assignee: Teresa Amorin, San Juan, PR (US)

( * ) Notice: Subject to any disclaimer, the term of this patent is extended or adjusted under 35 U.S.C. 154(b) by 0 days.

(21) Appl. No.: 10/821,291

(22) Filed: Apr. 9, 2004

(65) Prior Publication Data

US 2005/0225962 A1 Oct. 13, 2005

(51) Int. Cl.
*A45C 15/06* (2006.01)

(52) U.S. Cl. ..... 362/156; 362/103; 362/154

(58) Field of Classification Search ..... 362/154, 362/156, 103, 106, 190, 191, 155, 396
See application file for complete search history.

(56) References Cited

U.S. PATENT DOCUMENTS

| | | | | | |
|---|---|---|---|---|---|
| 2,288,996 | A | * | 7/1942 | Dubilier | 150/150 |
| 2,538,151 | A | * | 1/1951 | Grasak | 248/313 |
| 2,611,573 | A | * | 9/1952 | Young | 248/285.1 |
| 3,963,914 | A | * | 6/1976 | Browning et al. | 362/118 |
| 4,091,443 | A | | 5/1978 | Ohrenstein et al. | |
| 4,638,412 | A | * | 1/1987 | Weigert | 362/156 |
| 5,018,057 | A | * | 5/1991 | Biggs et al. | 362/295 |
| 5,070,438 | A | * | 12/1991 | Marshall | 362/206 |
| 5,416,675 | A | | 5/1995 | DeBeaux | |
| 5,764,132 | A | * | 6/1998 | Hill | 340/321 |
| 5,975,713 | A | * | 11/1999 | Brothers | 362/155 |
| 6,099,140 | A | | 8/2000 | Norris | |
| 6,663,265 | B2 | * | 12/2003 | Kovacik et al. | 362/375 |
| 6,848,807 | B2 | * | 2/2005 | Guerrieri | 362/155 |
| 6,893,143 | B2 | * | 5/2005 | Opolka | 362/241 |

FOREIGN PATENT DOCUMENTS

| | | |
|---|---|---|
| FR | 2 746 248 | 9/1997 |

OTHER PUBLICATIONS

Patent Abstract of FR 2 746 248, Ivsic Fredereic, Published Sep. 19, 1997.
International Search Report and Written Opinion issued in related International Application No. PCT/US05/012095.
International Preliminary Report on Patentability issued in corresponding International application No. PCT/US2005/12095.

* cited by examiner

*Primary Examiner*—Renee Luebke
*Assistant Examiner*—Gunyoung T. Lee
(74) *Attorney, Agent, or Firm*—White & Case LLP

(57) ABSTRACT

A device comprising a housing in the shape of a fashion accessory, the housing having a hollow interior, a top portion, and a bottom portion, wherein the hollow interior extends from the bottom portion to the top portion of the housing. A light source module is removeably attached to the top portion of the housing and extends substantially downward within the hollow interior toward the bottom portion. A handle is attached to the top portion of the housing, wherein the handle secures the device to a member within an article having substantially the same shape as the housing, wherein the device illuminates the article interior.

10 Claims, 8 Drawing Sheets

PORTABLE ILLUMINATION DEVICE

FIELD OF INVENTION

The present invention relates to devices for illuminating the inside of a handbag, purse, or other carrying devices, or even an area requiring illumination.

BACKGROUND OF INVENTION

Handbags and bags in general are used to carry many day-to-day use items, such as, for example, keys, purses, credit card holders, make-up, hair brushes, personal diaries, cell phones, and other such personal effects. With the ever increasing pace associated with work and daily life, people may tend to carry more personal effects in their bag. Consequently, they may be frequently faced with unavoidable situations in which they cannot immediately find their personal effects when searching through their bag. Therefore a portable illumination device that can be easily removed and inserted within a handbag, purse, or generally a bag, provides a person with the opportunity to more easily locate items and personal effects by illuminating the inside of their bag.

Although light sources and illumination devices for handbags or other forms of luggage are known, many such devices are not easily and conveniently interchangeable between different bags. Also, many of these devices are not designed to be aesthetically appealing in appearance. This may have an undesirable utility effect, where the person does not remember, want to transfer, or necessarily have the ability to transfer the light source to their current handbag or other luggage. Furthermore, some existing devices are located in awkward locations within a handbag. Therefore, if for some reason (e.g., battery failure) the light source fails, it may not be as easy to locate the light source amongst the contents of the handbag or bag in order to replace the battery.

In view of the foregoing, it is an object of the present invention to provide an optimally shaped, easily remembered illumination device for use in a handbag, other luggage or for general use.

It is another object of the present invention to provide an illumination device that makes efficient use of space within a handbag.

It is yet another object of the present invention to provide an illumination device that is easily transferable between various handbags, purses, or other bags.

SUMMARY OF INVENTION

The present invention solves at least in part the long felt, but unmet needs described above.

The lighting device according to the present invention, among other advantages, is in the shape of the object it provides light to, which provides an aesthetic appeal and also serves as a reminder to users that they can advantageously associate the light with the object to be lighted so that it will later be available for use, when necessary. According to another aspect of the invention the light can be conveniently clipped to the interior of the object. In addition, the light is available for general use, e.g., to locate a door lock after dark or to enable a user to navigate discreetly in an unlit facility, such as a theater.

In particular, the methods and structures of the present invention involve providing a device for illuminating an interior portion of an object having a preselected shape, wherein the device comprises a light source, a power supply, and a housing. The power supply is coupled to the light source, and the housing contains the light source and the power supply. The housing, in an embodiment of this aspect of the present invention, has a shape substantially similar to that of the object whose interior it illuminates. In the illustrated embodiment, the object is a handbag, purse or other bag, but could also take the shape of other sorts of luggage, an automobile, a house or other article or object that houses or contains other objects.

Another aspect of the present invention provides a lighting device comprising a housing substantially in the shape of a handbag and having an interior and an aperture for the passage of light. A light source resides in and is coupled to the interior of the housing. A power supply is coupled to the housing and to the light source and a switch is coupled to the power supply, such that when the switch is actuated, the light source is turned on.

Another aspect of the present invention provides a device comprising a housing in the shape of an accessory. The housing has a hollow interior, a top portion, and a bottom portion, and the hollow interior extends from the bottom portion to the top portion of the housing. A light source module is removeably coupled to the top portion of the housing and extends substantially downward within the hollow interior toward the bottom portion. A handle is attached to the top portion of the housing, securing the device to a member within an article.

A further aspect of the invention provides a method for illuminating an article. The method comprises the steps of providing a portable illumination device in the shape of the article for reminding a user to place the illumination device in the article. The illumination device is placed in the article by securing the illumination device to a member within the article and activated so that the interior of the article is illuminated for the purpose of locating items placed within the article by the user.

Another aspect of the invention provides a method for selling an accessory, such as a fashion accessory. The method comprises offering for sale a consumer article, providing the accessory having a shape substantially similar to that of the article, and offering the accessory for sale by presenting the accessory in visual proximity to the article, for encouraging a potential buyer to purchase at least one of the article and the fashion accessory.

DETAILED DESCRIPTION

Figure 1:
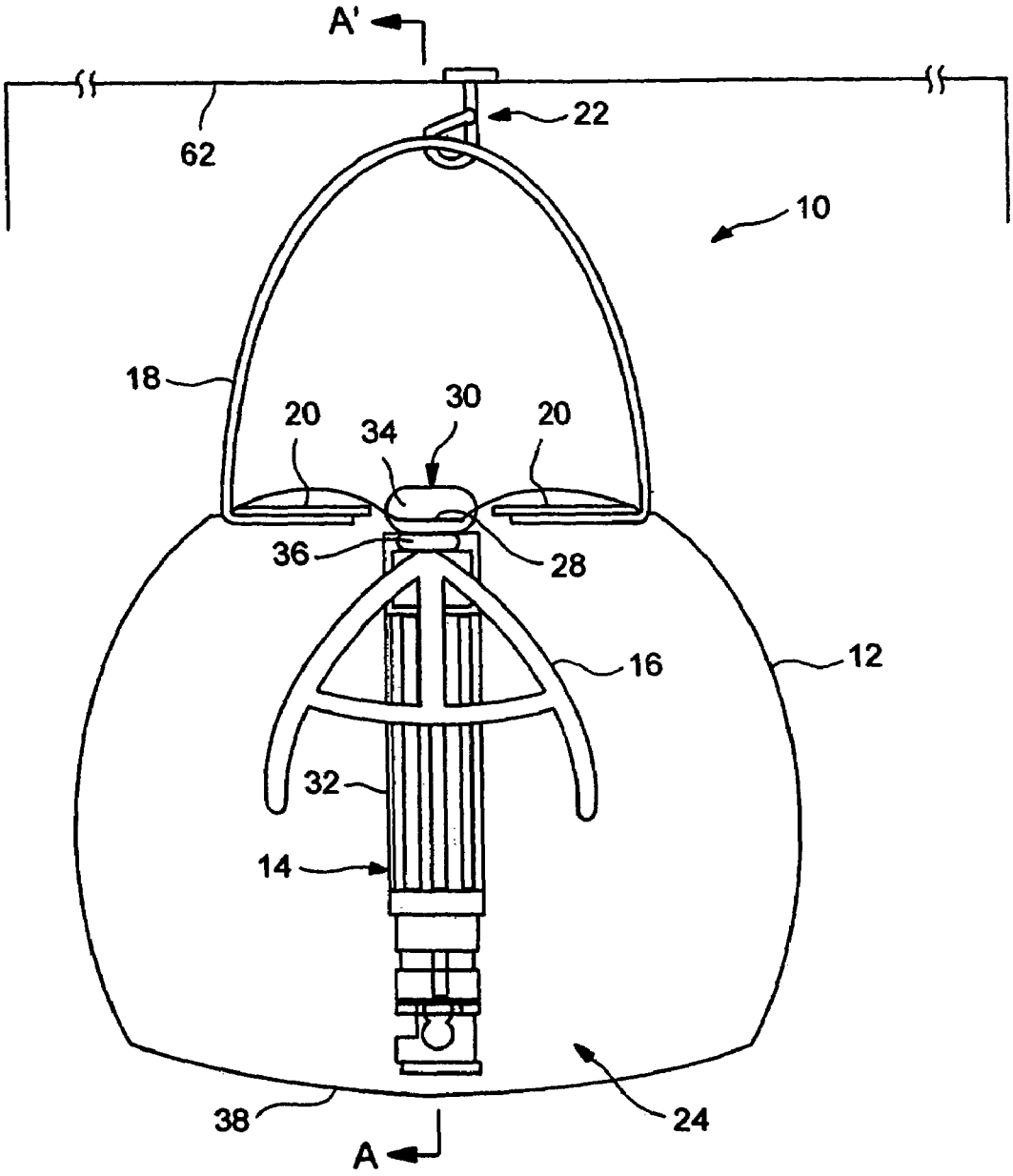
FIG. 1 illustrates an embodiment of the illumination device according to the present invention, in elevation, with the housing shown in cross-section.

FIG. 1 illustrates an illumination or lighting device 10 according to the present invention. In this embodiment, but without limitation, the lighting device 10 is in the shape of a handbag and may be used for illuminating the inside of a handbag or other bag. Illumination device 10 comprises a housing 12, a light source module 14, a switch device 16, and a handle 18. In the illustrated embodiment, lighting device 10 is substantially in the shape of a handbag, but the invention is not limited to such embodiment. Lighting device 10 may similarly be shaped to resemble or illuminate the contents of any luggage or article serving as a container, for example, a briefcase, lunch box, suitcase, makeup case, toiletry bag, etc. It may also be used to resemble and illuminate the interior of a user-designated area, such as, a car, or locker. In accordance with an aspect of the present invention, lighting device 10 may substantially resemble the shape of any article or object that it is intended to illuminate or provide lighting to.

Lighting device 10 may be secured to the inside of the handbag using handle 18. Handle 18 can be rotated about hinges 20 to couple the lighting device 10 in a known manner to the inside partition member or divider of the handbag. Alternatively, handle 18 may be hung from any hook or suitably shaped fixture, such as, for example fixture 22, which may form part of a handbag partition member or divider 62, or be adapted as a separate attachable/detachable fixture for use within the handbag.

Switch 16 may be any suitable switch, such as a mechanically actuated switch, that is activated each time the switch is actuated. Switch 16 could, in one embodiment, also incorporate voice-activated technology, where the user of lighting device 10 is given the opportunity of activating the light source module 14 by a single voice command (e.g., "ON," or "OFF"). Also, when the light source module 14 is activated to the "ON" state, and thus generating light, module 14 may be deactivated on a timed basis following the "ON" state in order to preserve battery power and increase convenience of use.

In the illustrated embodiment, housing 12 includes an aperture 24 located at the bottom portion of the housing 12. Aperture 24 which may comprise an actual opening or a visual opening through which light only can pass. Alternatively, the aperture could be located elsewhere in the housing 12, such as on one or more sides of the housing including the bottom, and could comprise a plurality of apertures. The hollow interior of housing 12 accommodates light source module 14, which extends from the top portion of housing 12 in the direction of aperture 24. Aperture 24 confines the light generated by module 14 and transmitted out of housing 12 and onto an area, object(s), or content to be illuminated. Housing 12 may be made of a clear plastic material, semi-transparent material, or opaque material, and it may include any light enhancing coating or reflector for increasing the proportion of light energy exiting housing 12 through aperture 24. Housing 12 also includes an opening 26 (FIGS. 3 and 5) enabling switch 16 to access and activate the light source module 14 located within housing 12. The housing 12 further comprises a second opening 28, located on its top portion, and used for securing light source module 14 to housing 12.

In the illustrated embodiment, light source module 14 comprises an end cap 30 having a cap head 34 and a coupling portion 36. Coupling portion 36 is passed through opening 28 and snap fits into an opening at the top end of the module's 14 body portion 32. Head 34 of end cap 30 has a larger diameter than opening 28. The light source module 14 is secured against the top portion of the housing by means of the end cap 30, once the coupling portion 36 is pushed into the opening of body portion 32. Coupling portion 36 may screw fit, snap fit, or use any other suitable coupling mechanism for being joined into the opening of body portion 32.

In the illustrated embodiment, the bottom portion of the housing 12, as indicated by reference numeral 38, includes a cover that is substantially transparent to light. Cover 38 may include patterning or contouring that directs the emitted light from aperture 24 at a particular angle of divergence. For example, some covers may provide a higher angle of divergence, which is more suitable for illuminating larger bags, whereas other covers may provide a smaller angle of divergence of emitted light, which provides a more focused, higher intensity concentration of light for illuminating smaller bags.

Figure 2:
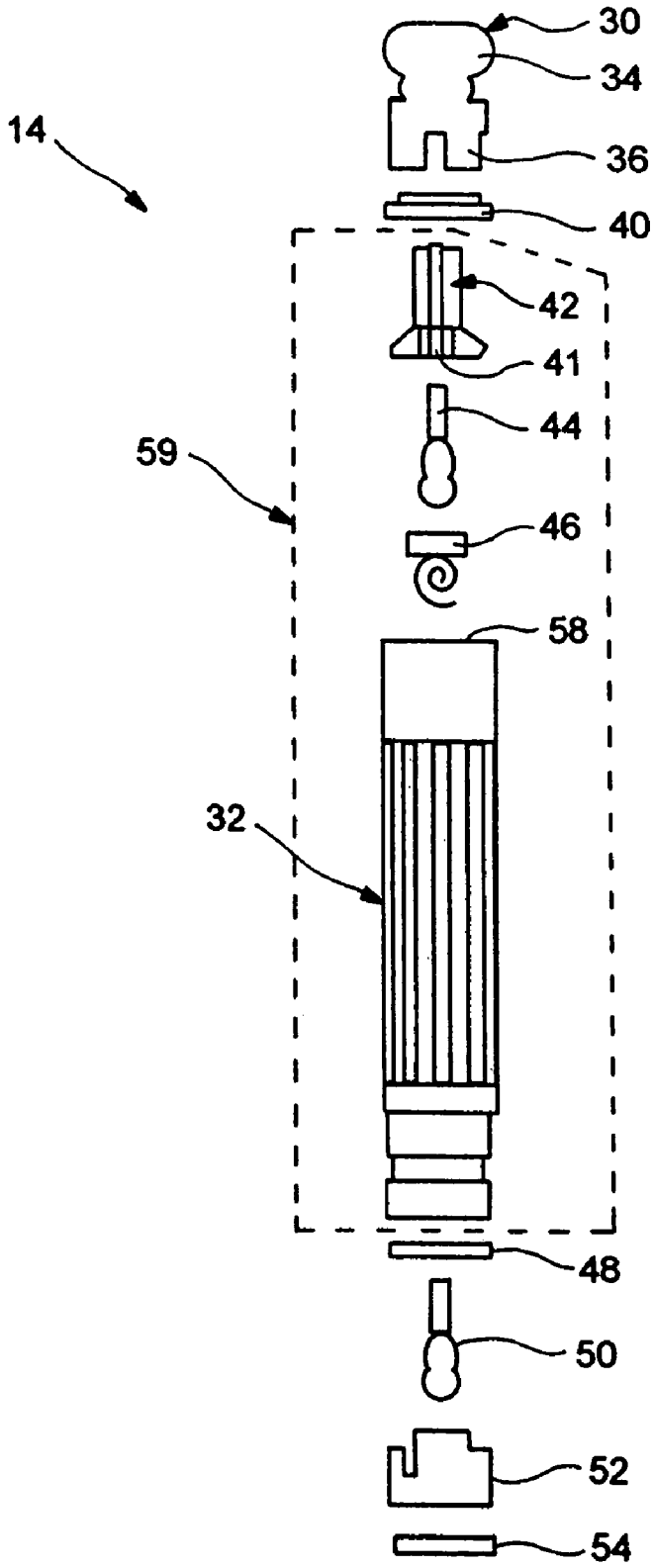
FIG. 2 illustrates an exploded, elevation view of a light source module used within the illumination device shown in FIG. 1.

FIG. 2 illustrates an embodiment of a light source module 14, which includes an end cap 30, a lip seal 40, an electrical contact 42, a battery spring 46, body portion 32, an O-ring 48, a luminescent device 50, a reflector 52 for redirecting light energy received from luminescent device 50 in a substantially downward direction, a lens 54, and a spare luminescent device 44 for replacing luminescent device 50, upon its failure (i.e., luminescent device 50). As discussed in relation to FIG. 1, end cap 30 includes coupling portion 36 and head portion 34. Coupling portion 36 may snap fit into opening 58 at the top portion of body 32, or alternatively, coupling portion 36 may push fit into opening 58. As end cap 30 is attached to the body 32 of the light source module 14, it pushes lip seal 40 against the electrical contact 42, which in turn establishes electrical contact with battery spring 46, compressing battery spring 42 against the batteries (not shown) located in body portion 32. Thus, the batteries are secured and establish a good electrical connection with contact 42. Electrical contact 42 may also include a hollow opening 41 for accommodating the additional luminescent device 44, so that the luminescent device 44 is not damaged as the end cap 30 is pushed down on the lip seal 40, electrical contact 42, and battery spring.

Body portion 32 of light source module 14 may also be referred to as battery barrel 32, since this portion accommodates the batteries needed for supplying power to luminescent device 50. Battery barrel 32 which holds the battery or batteries, and corresponding electrical contacts which provide electrical connections to luminescent device 50 from the light source module's 14 power supply 59.

Figure 3:
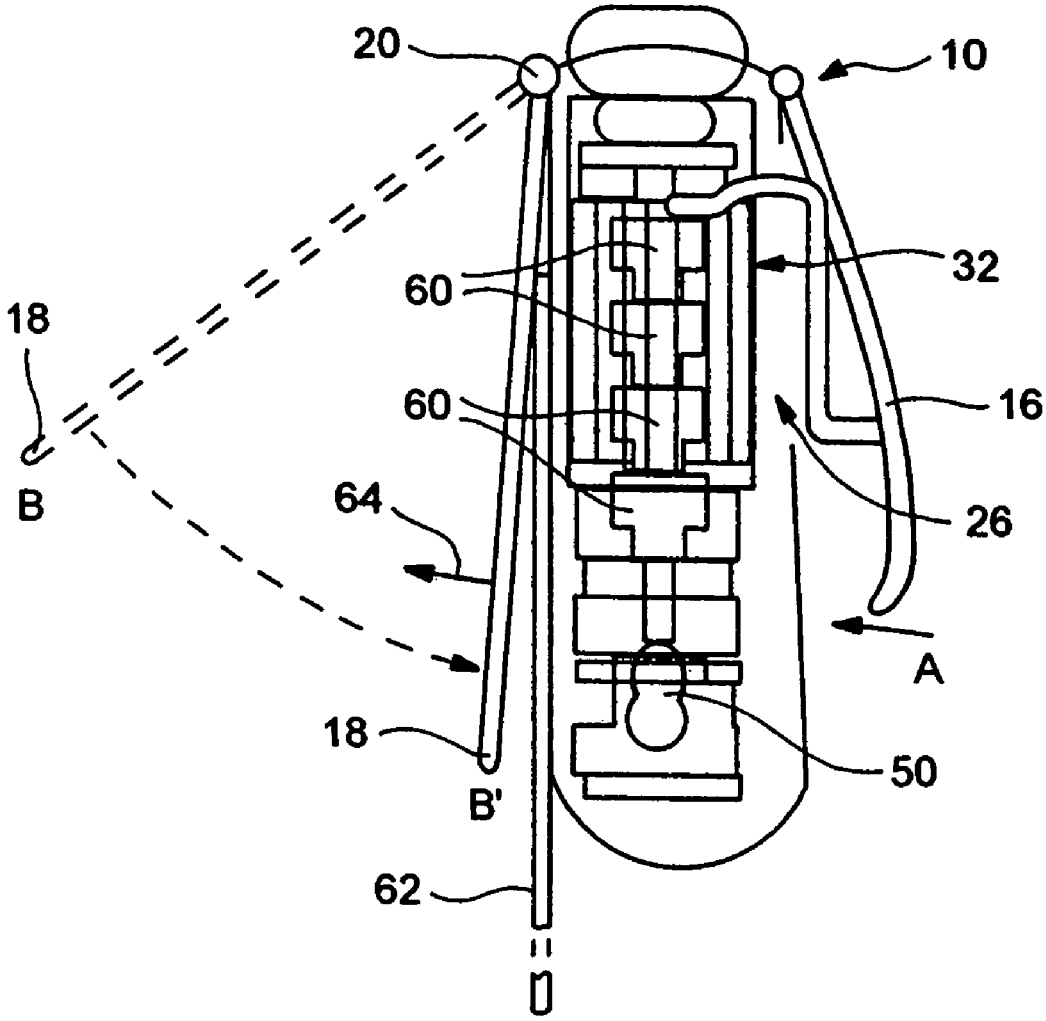
FIG. 3 illustrates the illumination device of FIG. 1 through a cross-section A-A'.

As illustrated in FIG. 3, battery barrel 32 may include hearing aid batteries 60 to provide sufficient operating current for luminescent devices 44 and 50. Any suitable battery cell or electrical storage device capable of delivering the required operating voltage and current to a luminescent device may be used. Also, luminescent devices 44 and 50 may include a miniature light bulb, a light emitting diode (LED), or any such device suited for providing visible light for illuminating an area and/or object.

FIG. 3 shows a side view of lighting device 10 shown in FIG. 1. As illustrated, handle 18 is manipulated from position B to position B' in order to secure lighting device 10 to a partition member or section divider 62 with a bag or handbag (not shown). Hinge 20 may incorporate any suitable mechanism for ensuring that once handle 18 is in position B', it will not move in the direction of arrow 64, and in doing so eventually cause lighting device 10 to become detached from partition member or divider 62. Such detachment is a risk, since bags or handbags, when in use, undergo a great deal of movement, if not shock, which could drive handle 18 away from position B and diminish the force that handle 18 is intended to exert against divider 62.

As previously disclosed, switch device 16 is actuated in order to activate or deactivate the power supplied by power supply 59 (FIG. 2) to luminescent device 50. Pressing switch 16 in the direction of arrow "A" may both activate or deactivate power supply 59.

Figure 4:
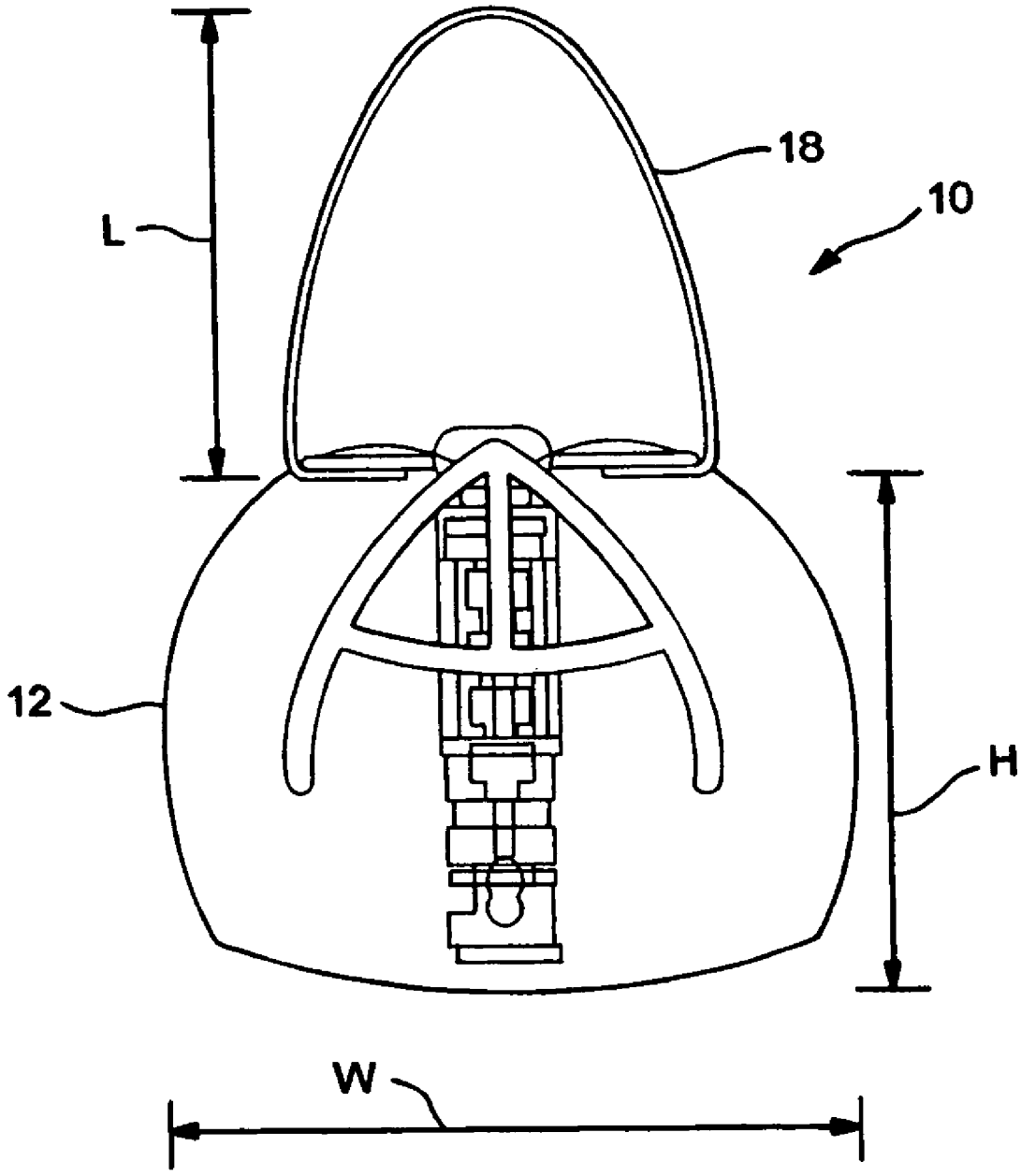
FIG. 4 illustrates a front elevation view of the illumination device, showing the practical dimensions of the device.

In the illustrated embodiments, the lighting device has substantially the same shape as the handbag whose interior it illuminates, through the invention is broadly applicable to other luggage or articles used for containing objects that may require illumination when in use. Also, its dimensions are such that it fits within most bags, and makes efficient use of the interior space. As show in FIG. 4, in one embodiment the dimensions of lighting device 10 are denoted by dimensions "H," "W," and "L." As illustrated, dimension "L" is the height of the handle 18, which is approximately 1.8 inches. Dimension "W" is the width of housing 12, which is approximately 2.4 inches, and "H" represents the height of housing 12, which is approximately 2.2 inches.

Figure 5:
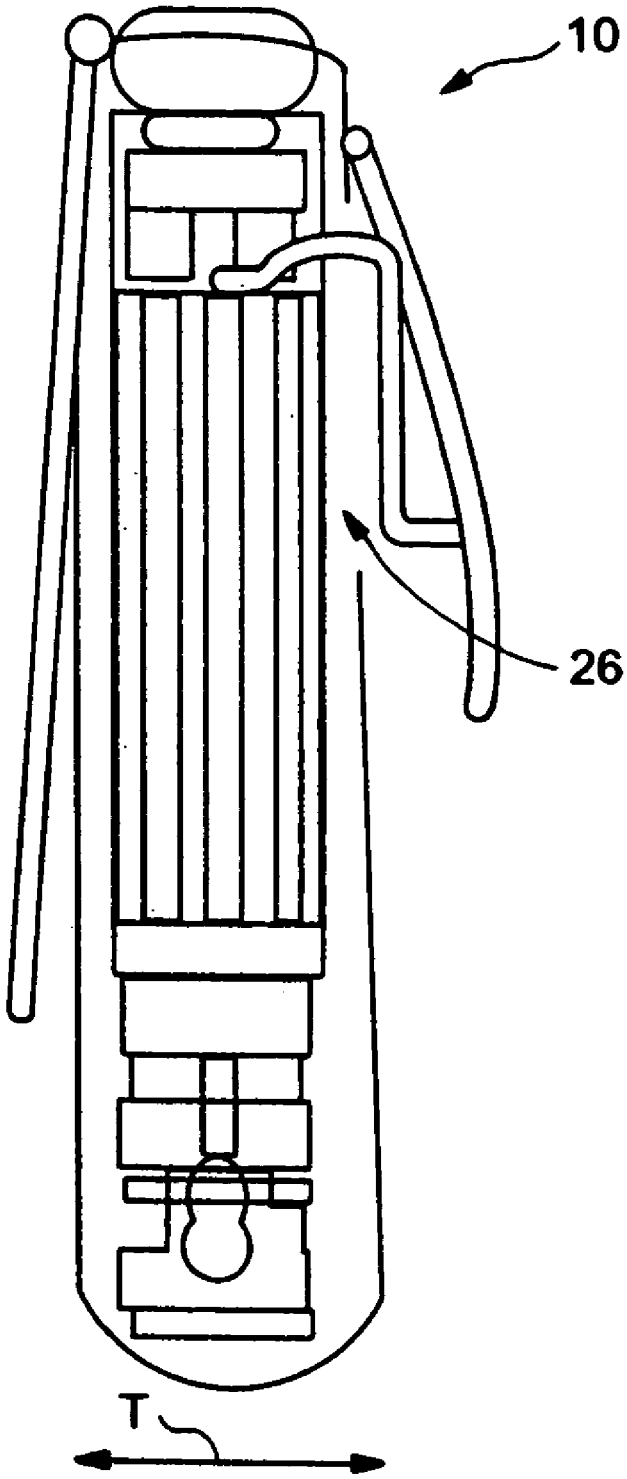
FIG. 5 illustrates an elevation view of the illumination device from a side perspective, showing the dimensions of the device.

The thickness of the device 10 is denoted by dimension "T," as illustrated in FIG. 5, where "T", in an embodiment of the invention, is approximately 0.75 of an inch. Device 10 is not limited to these particular dimensions, but can be scaled to any suitable absolute or relative dimensions based on the shape and size of the interior it is intended to illuminate. Also, when the illumination device is in the shape of the item or article it is intended to illuminate, it serves as a reminder that it should be placed in that item or article.

Figure 6:
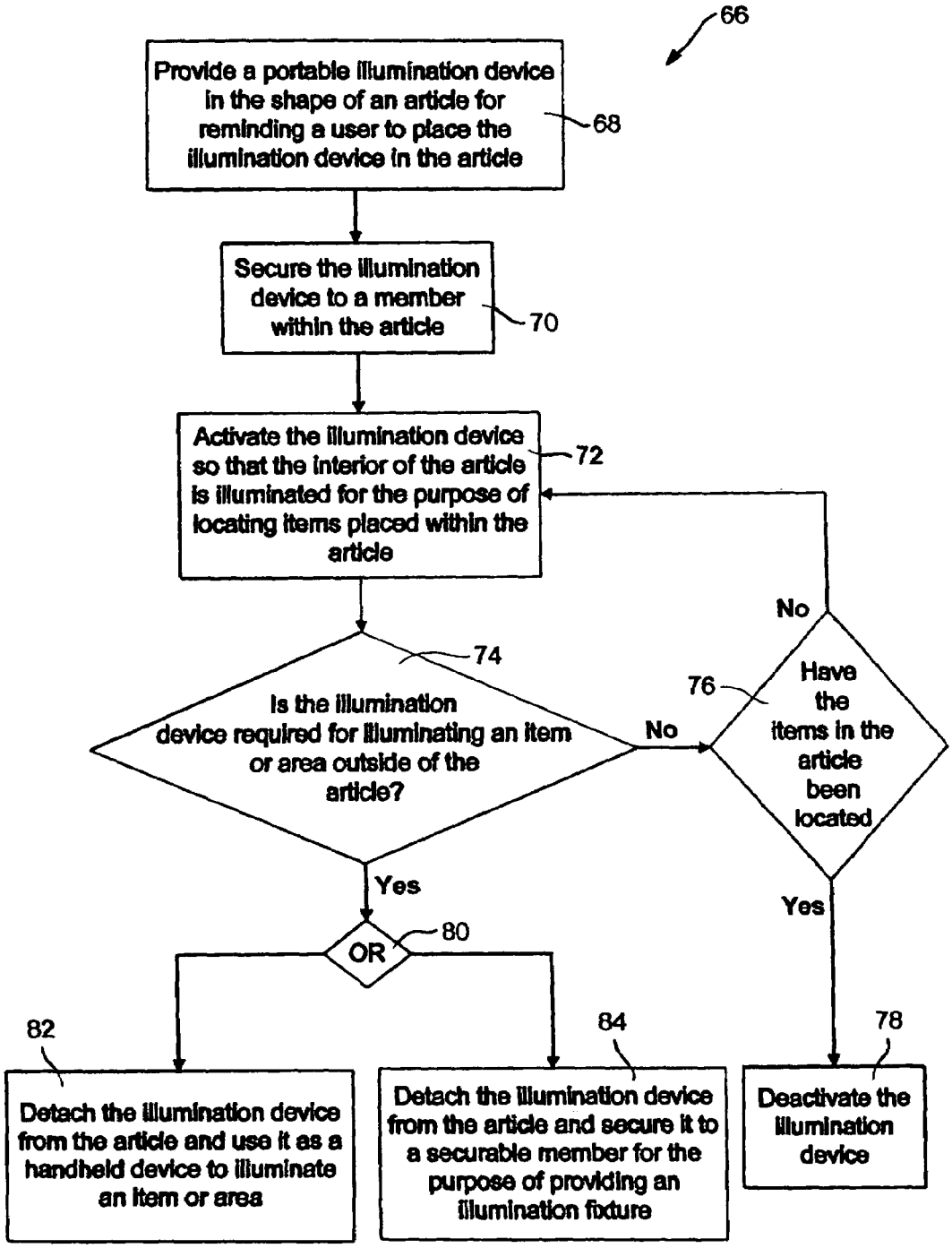
FIG. 6 illustrates a flow chart representing a method of using the illumination device according to an embodiment of an aspect of the present invention.

FIG. 6 illustrates a flow chart 66 of an embodiment of a method for using an illumination device according to the present invention. Some or all of the steps may be used according to the present invention. Step 68 includes providing a portable illumination device that has substantially the same shape as the article that it is used to illuminate. By having the substantially the same shape as the article, the shape of the illumination device reminds the user to place the illumination device within the article. Once the user is reminded of the illumination device, in step 70, the illumination device is secured to a member or fixture within the article. For example, if the article is a handbag, the illumination device may be in the shape of a handbag and may either be secured to a section divider, or in the case of some handbags, to a fixture that is specifically provided for receiving and securing the handbag shaped illumination device to the handbag (e.g., fixture 22 in FIG. 1).

In step 72, once the illumination device is secured within the article, it is activated in order to illuminate the contents of the article. Step 74 indicates whether the user wants to illuminate an item or area outside of the article. If the user does not want to illuminate an item or area outside of the article, at step 76, the user may determine whether the item they are looking for has been found as a result of illuminating the contents of the article. Provided that the item has been found, at step 78, the illumination device may be deactivated. If the item in question is not found within the article, it is either reactivated or left in the activated state, as indicated at step 72. In a case where the illumination device has a switch device that remains actuated based on a timer, re-actuation may be required if the time period for the illumination device remaining in the 'ON' state expires. If the switch device is actuated manually, the illumination device will already be and remain in the 'ON' state until the user decides to deactivate the illumination device.

At step 74, if the user desires to illuminate an item or area outside of the article, at step 80, the user has two options. At step 82, the user may detach the illumination device and use it as a hand held device for illuminating any desired item or area. Alternatively, at step 84, the user may detach the illumination device from the article and secure it to an external member, so that it may be used as an illumination fixture. For example, the illumination device may be removed from the article and attached to a hook fixture located above the passenger doors in the interior of an automobile (e.g., without limitation, such as is often used for supporting clothes hangers). By attaching the illumination device to such a fixture, it may be used as a reading light.

Figure 7:
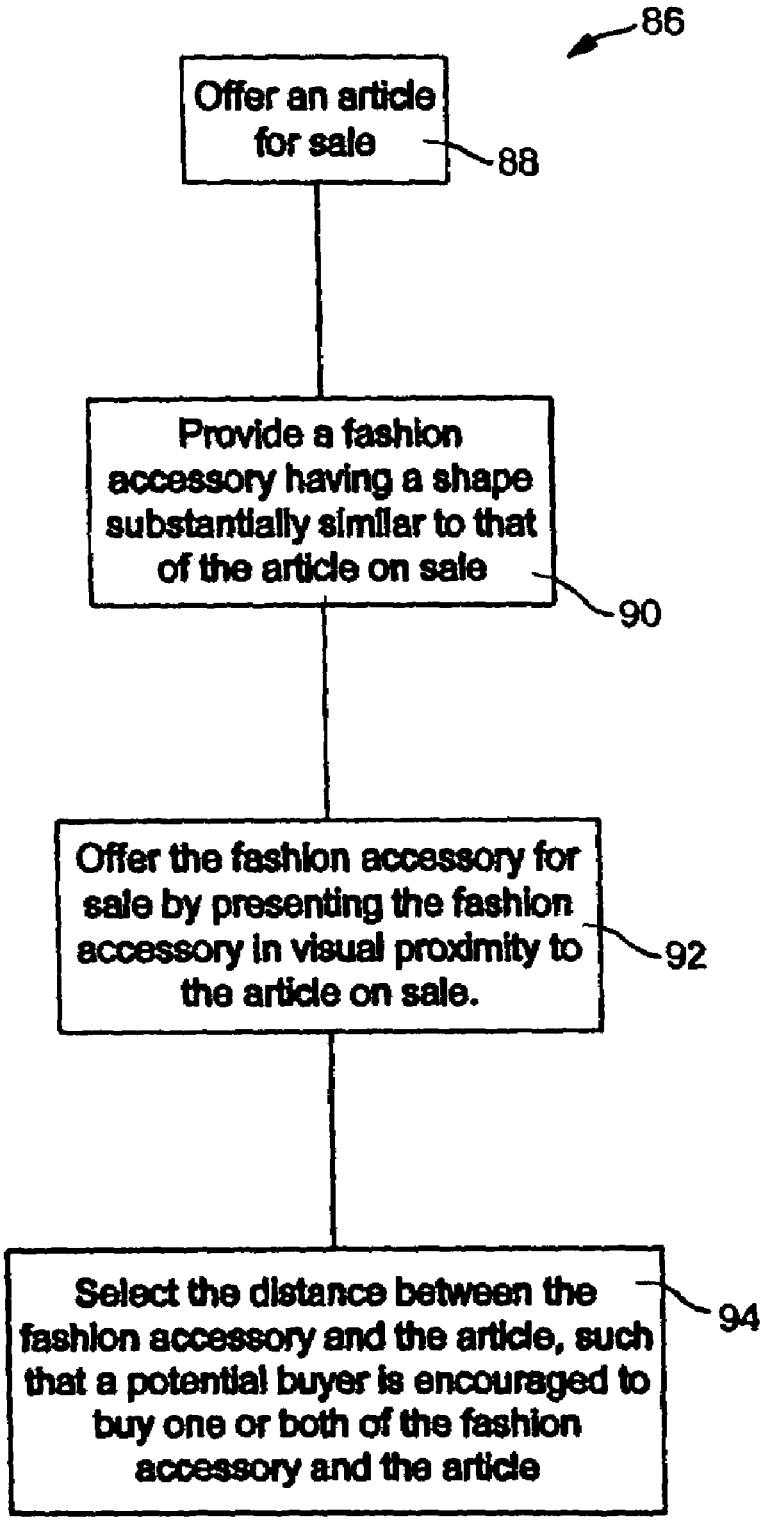
FIG. 7 illustrates a flow chart representing a method of offering for sale an accessory having substantially the same shape as another article on sale according to an embodiment of an aspect of the present invention.

FIG. 7 illustrates a flow chart 86 embodying a method, according to the present invention, for offering for sale a lighting device, as described above, or other accessory, such as a fashion accessory. At step 88, an article is offered for sale and displayed. Once the article has been displayed for sale, at step 90, an accessory is selected having substantially the same shape as, but preferably appreciably smaller dimensions than, the displayed article that is selected. At step 92, the accessory is offered for sale by placing it in visual proximity to the article for sale. As shown at step 94, the distance between the accessory and the article is selected such that a potential buyer is encouraged to buy both the article as well as the accessory. The distance between the article and the corresponding accessory will depend on both the size of the article and the accessory. For example, the separation between the two may range from between a few inches to up 10-15 feet or more (depending on the scale and size of the article and the accessory offered for sale). In another aspect of the present invention, not only the shape but also the surface ornamentation, color, material(s) of manufacture or other characteristic of the accessory is (are) selected to correspond to those of the article.

For one example, the lighting device 10 in the shape of a handbag is also an accessory suitable for use with such handbags. By placing the lighting device 10 in visual proximity to the handbags that are on sale, the potential buyer is thus encouraged to buy both the handbag-shaped lighting device and the handbag. This approach is equally suitable for use with lighting devices 10 according to the present invention that resemble other sorts of articles.

Figure 8:
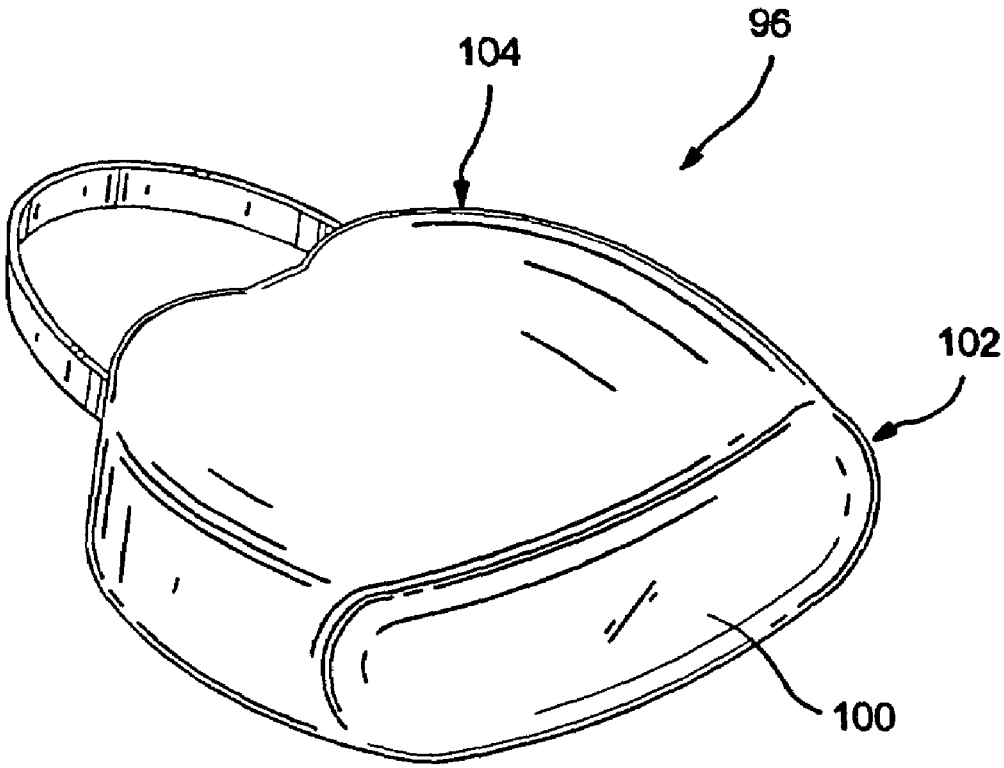
FIG. 8 illustrates a perspective view of the illumination device according to an embodiment of an aspect of the present invention.

FIG. 8 illustrates a lighting device 96 in the shape of a handbag according to an embodiment of an aspect of the present invention. Light exits (not shown in this view) transparent region 100, located at the bottom portion 102 of housing 104. The bottom portion of housing 104 may also include an aperture (not shown), whereby the size and shape of the aperture may vary according to the desired divergence angle of light exiting housing 104. The transparent region 100 located at the bottom portion may be made of a clear plastic, a colored plastic, a fully transparent, or a partially transparent material based on the desired effect and/or intensity of light exiting housing 104. In another embodiment, the aperture can be formed in another location, such as between the top and bottom 102 portions of housing 104. The aperture may also be formed on the fully or partially transparent material 100.

In addition to the embodiments of the aspects of the present invention described above, those of skill in the art will be able to arrive at a variety of other arrangements and steps which, if not explicitly described in this document, nevertheless embody the principles of the invention and fall within the scope of the appended claims. For example, the ordering of method steps is not necessarily fixed, but may be capable of being modified without departing from the scope and spirit of the present invention.

What is claimed is:

1. A lighting device for use with an article, the lighting device comprising:

(a) a housing in the shape of a fashion accessory, the housing having an interior, a top portion, and a bottom portion, wherein the interior extends from the bottom portion to the top portion of the housing;

(b) a light source module coupled to the top portion of the housing and extending substantially downward within the interior toward the bottom portion; and (c) a handle attached to the top portion of the housing, the handle securing the lighting device to a member, and within the article, the article having substantially the same shape as the housing, wherein the handle comprises a hinge for manipulating the handle between a first and a second positions, wherein manipulating the handle to the first position facilitates carriage of the lighting device, and manipulating the handle to the second position facilitates securing the lighting device to the member, within the article, wherein the lighting device illuminates the article interior.

2. The lighting device of claim 1, wherein the light source module comprises:

(a) a battery barrel having a first and second end and adapted to hold at least one battery;

(b) a first luminescent device for illuminating the article interior, the lighting device disposed adjacent to the first end of the battery barrel and adapted to be electrically coupled to and powered by the at least one battery;

(c) a securing cap adjacent to the second end of the battery barrel for encapsulating the at least one battery within the battery barrel and securing the illumination device to the top portion of the housing; and (d) a switch for activating and deactivating the luminescent device, whereby the interior of the article is illuminated.

3. The lighting device of claim 1, wherein the bottom portion is substantially transparent to light, to allow light generated by the light source module to exit from the housing and illuminate the article.

4. The lighting device of claim 2, wherein the switch device comprises a pressure activated component for activating and deactivating the luminescent device.

5. The lighting device of claim 2, wherein the switch device comprises a voice recognition device for activating and deactivating the luminescent device in response to a users voice command.

6. The lighting device of claim 2, wherein the switch device comprises a timing device for deactivating the luminescent device after a predefined time period following activation of the luminescent device.

7. The lighting device of claim 2, wherein the luminescent device comprises a light bulb.

8. The lighting device of claim 2, wherein the luminescent device comprises a light emitting diode.

9. The lighting device of claim 2, wherein the light source module includes a second luminescent device disposed in a housing between the securing cap and a second end of the battery barrel, wherein the second luminescent device is adapted to be substituted for the first luminescent device if the first luminescent device fails.

10. The lighting device according to claim 1, wherein the shape of the fashion accessory substantially comprises at least one of the group consisting of a handbag, a briefcase, a suitcase, a backpack, a makeup case, and a toiletry bag.

* * * * *